US006389984B2

(12) United States Patent
Brandt

(10) Patent No.: US 6,389,984 B2
(45) Date of Patent: May 21, 2002

(54) INDEPENDENT DOG OPERATING SYSTEM

(75) Inventor: Calvin J. Brandt, Delano, MN (US)

(73) Assignee: Calbrandt, Inc., Delano, MN (US)

( * ) Notice: Subject to any disclaimer, the term of this patent is extended or adjusted under 35 U.S.C. 154(b) by 0 days.

(21) Appl. No.: 09/546,956

(22) Filed: Apr. 11, 2000

(51) Int. Cl.[7] ..... B61J 3/04
(52) U.S. Cl. ..... 104/162; 104/172.5; 104/178
(58) Field of Search ..... 104/162, 176, 104/166, 172.5, 177.3, 178; 414/359

(56) References Cited

U.S. PATENT DOCUMENTS 3,696,754 A * 10/1972 Anderson et al. ..... 104/162
4,175,656 A * 11/1979 Lang ..... 198/748
4,354,792 A * 10/1982 Cornish ..... 414/359
4,633,784 A * 1/1987 Hoehn et al. ..... 104/162
4,893,883 A * 1/1990 Satzler ..... 305/10
4,926,733 A * 5/1990 Janson ..... 83/819
5,709,153 A * 1/1998 Brandt ..... 104/162
5,902,089 A * 5/1999 Sinn et al. ..... 414/398
6,006,673 A * 12/1999 Brandt ..... 104/162

* cited by examiner

*Primary Examiner*—S. Joseph Morano
*Assistant Examiner*—Frantz F. Jules
(74) *Attorney, Agent, or Firm*—Nikolai & Mersereau, P.A.

(57) ABSTRACT

A dog carriage for a railway car indexing system for positioning a railway car or a trip of coupled railway cars having railway wheels mounted in and carrying bogey wheel truck frames by engaging and pushing against the bogey wheel truck frames using dogs includes a dog carriage frame moveable along a railroad track, a pair of spaced opposed dogs pivotally attached to the dog carriage frame for pivoting between a lowered position and a raised position to engage a bogey wheel truck frame in the raised position by movement of the dog carriage frame. A bogey wheel truck frame sensing device is carried on the dog carriage and a dog operating system is provided for controlling the position of each of the dogs individually between the lowered and the raised position.

7 Claims, 5 Drawing Sheets

INDEPENDENT DOG OPERATING SYSTEM

BACKGROUND OF THE INVENTION

I. Field of the Invention

The present invention relates generally to train handling equipment, more particularly, to railway car spotting or indexing systems used to position cars in a trip precisely along a track to be addressed by loading and unloading operations at fixed stations. One type of system of the class commonly employs alternating left and right indexing devices, each of which includes a carriage having a pair of opposed pivotally retractable ruggedly constructed car-engaging pusher devices known as "dogs" which push against the bogey carriage frames or axles of the car. In addition to being used as pushers, the dogs are normally employed in detecting the presence of a car by advancing the indexer with the dogs up until a dog is deflected by a bogey frame or axle. This invention focuses on providing improvements in the operation of a bogey frame pushing system by eliminating the need to use the dogs, themselves, to detect the presence of a car and providing a system that allows separate control for each dog in a reversing dog carriage assembly associated with a car-spotting setup.

II. Related Art

Freight-hauling railway cars need to be positioned proximate freight or cargo handling equipment during loading and unloading operations. Freight, in the form of bulk cargo such as grain, coal, iron ore or the like, is typically dumped or emptied out of railway cars by dumping the cars themselves or by using stationary freight-handling equipment such as chutes and conveyor equipment located in pits beneath the tracks. Coal gondolas and cars for transporting grain or other finely divided dry bulk agricultural material may be covered and provided with a plurality of spaced bottom discharged hopper bins or chutes accessing the main storage volume enclosed by discharge gates. As discussed below, these gates may be operated more easily by using tripper rods which extend outward from the sides of the cars to allow easy access and gate operation. These cars are also designed to be positioned for discharge over dedicated recessed receiving facilities situated at fixed stations such as grain or coal bins and conveyors which are positioned beneath the railroad track.

In the discharge operation, a locomotive roughly positions one end of a string or trip of cars to be unloaded over the receptacle. Locomotives, of course, are not well suited for indexing or precisely positioning individual cars or even sets of cars along the track, let alone over individual cargo receiving bins. To this end, positioning devices known as railway car spotters, indexers or positioners have been built and operated at fixed stations.

Railway car indexers of interest here include at least one car-engaging dog for engaging at least one railway car in a string or trip of cars and moving the string a given distance along the railroad track. The engaging member is often situated and operated along an auxiliary indexer track or guideway juxtaposed in a parallel relation to the railroad track itself in the fixed receiving facility. Fluid-operated linear actuators, such as hydraulic cylinders may be connected to chains, or chains and sprockets driven by hydraulic or electric motors may be used to supply power for moving the dogs and hence, the railway cars.

In one type of indexing apparatus, dogs in the form of heavy vertically pivoting car-engaging arm members are used which are designed to engage either the railway bogey wheel truck frame or an axle. The dogs are smaller than car coupler engaging arms and are carried on dog carriages situated either between the rails of the track to engage the axle or next to the track to engage the bogey truck frame. Bogey frame-engaging dog systems may be further divided into two types. One type that includes "low dogs" which are dogs that engage the lower portion of the truck frame below axle height; the other employs "high dogs" which engage the frame at or above the height of the axles. One such system using high dogs is described in U.S. Pat. No. 5,709,153 to Brandt, the inventor of the present invention, and is assigned to the same assignee as the present invention.

These car moving systems typically include left and right indexers which, in effect, operate alternately to hand off consecutive sequentially connected cars in a trip of cars so that the entire trip may be advanced and unloaded, one car at a time. Each indexer is designed with the ability to stop at any point during an alternating stroke. Traditionally, indexer carriages have been hydraulically operated and designed to travel forward with spaced oppositely directed dogs which, in the case of bi-directional or reversing systems, are pivotally mounted (bottom pivoted) to drop toward each other and are raised facing each other to sense and engage a railcar. In this manner the back side of a dog will initially strike an interfering object enabling the struck dog to pivot or deflect downward away from the object. The event of a dog contacting the bogey frame can be sensed by a resulting change in system hydraulic pressure produced by the deflection of the dog. This has become a trusted and reliable method for sensing the presence of and then engaging a car. Using this method, the first dog encountering the bogey frame of a car is pushed down from behind and the second dog in the pushing posture engages the bogey frame of the car as the indexer continues to move. While these systems work quite well with conventional cars, tripper rods which have since been added to the outside of many types of railcars have introduced a problem. These devices extend outward from the lower portion of the side of the railcars and are used as a convenient method for one standing along side of the car to operate the bottom discharge mechanisms in gondolas, hopper and other bottom discharged cars. These devices are not compatible with bogey carriage engaging dogs, however, because the rods are positioned such that they can be struck and damaged or destroyed by a raised dog further possibly resulting in catastrophic damage to the railcar hopper opening mechanism.

Devices utilizing sprockets and continuous chains have been devised which can be used to lower both dogs of an indexer or carriage simultaneously during the car finding or engaging operation to prevent interference with car tripper rods. These devices, however, do not allow operation with a single raised dog in contact with the bogey frame once sensed and operating as a pusher dog.

Accordingly, there exists a definite need to provide a mechanism to sense cars that does not require contact with the dogs thereby eliminating the possibility of tripper rod damage.

Accordingly, it is a principle object of the present invention to provide an improved car spotting system having dogs which operate on the bogey carriage when moving the cars but which do not interfere with the existence of any tripper rods or other protruding devices on the cars.

It is a further object of the present invention to provide an indexing system that does not use the dog devices to sense the presence and location of a railway car.

Another object of the invention is to provide such an indexing system in which the forward and rearward dogs of each carriage on the left and right indexers are individually controllable.

Other objects and advantages of the invention will become apparent to those skilled in the art upon familiarization with the specification, drawings and claims contained herein.

SUMMARY OF THE INVENTION

The present invention provides a railway car indexing or spotting system capable of detecting bogey frames in the presence of interfering devices such as tripper rods. The system is useful for both high or low dog indexers, whether una-directional or reversing. The system features independent bogey frame detection devices that do not require direct contact between the dogs and the bogey frame to detect the presence of a railcar. This eliminates the need for the indexers to travel forward with dogs raised to engage a railcar. Such sensing devices may include limit switch devices or roller cam devices connected to the hydraulic system which do not interfere with other aspects or appendages of the railcar.

Independent pivotal operation is enabled for each dog in the spotting system. With dual or reversing systems, independent control is provided for both dogs in each of the left and right index carriages and for each dog in single dog non-reversing index pairs.

The dual dog reversing indexing carriages each include a pair of opposed pivotally mounted dogs, which can be high or low, and which can be used to move cars of a trip in either direction in conjunction with a second indexing carriage which operates in tandem with the first to hand off each car and continue the motion of the trip. The control of individual dogs of an indexer in such a system is an important aspect of the invention. As described in the detailed description, each dog is a bottom pivoted pusher arm which is spring biased to remain in a raised posture unless forced down by a bogey carriage, by the control system of the invention or other means to overcome the spring bias. Each dog then is designed to pivot in one direction and engage and pull in the other. The individual dog control system of the invention includes a fluid operated linear actuator, preferably a hydraulic cylinder, which tensions a chain extending between a fixed chain connector and the rod of a fixed cylinder, passing over idler sprockets therebetween which control the posture of the dog. A control system for each carriage includes a pressure compensated hydraulic pump or other source which supplies high pressure fluid for the operation of both dogs. Each dog has its own pressure reducing and directional control valves so that the tension on the individual chains associated with each dog can be separately adjusted. In this manner, at least the reduced pressure is applied to the hydraulic cylinders any time the power to the unit is on. The pressure as limited by the pressure reducing valves or the high pressure fluid are selectable using an in-line controlled two-position valve. The pressure reducing valves are set at a pressure that is sufficient to keep each chain taut and on the sprockets, but insufficient to lower the dogs.

In operating a high dog system using the invention, when the indexer is moving through the track looking for a car, or performing a transfer, the dogs will be pulled down by retracting the cylinders at higher pressure, perhaps 1600 psi. When the dogs are down, another locating system, such as a cam actuated system, will become active to look for the next bogey truck frame of a railway car. In the case of a cam operated system, spaced deflectable cams, one near each high dog, are connected in the system in a manner such that when a cam goes under a bogey frame of the car, it will deflect and the chain of the corresponding dog will be pulled causing a pressure spike that is used to indicate that the indexer has gone under a bogey frame of a car. The pressure spike will go away when the cam actuator comes out from under the bogey frame and the cam returns to a neutral position. The indexer will stop moving to allow the appropriate dog, i.e., the dog that engages in the direction the cars are being moved, to assume a raised position and the indexer will move it towards the car. In this manner, a bogey frame can be engaged as a transfer from the opposite indexer or as an initial engagement of the trip of cars without initially raising the dogs.

In the case of a low-dog indexing system of the dual dog or reversing class, in many cases the dogs themselves can still be used to sense the presence of the bogey frame in the traditional manner if there is no danger of damage to the cars or the system can be operated in the manner of a high-dog system using separate limit switches operated by movement of the cylinder rod chain connector linking devices to find the next bogey wheel frame. If the system is operated in the traditional manner, the pressure is limited by the pressure reducing valves to an amount adequate to keep the chain taunt, but inadequate to lower the dogs. In this manner, when a dog is lowered by engaging a bogey frame, this causes the chain tension to decrease and the cylinder to retract a given amount. This deactivates a limit switch, normally activated by the chain connector as the connector moves away from it. This action signals the PLC to let it know that the carriage has traveled under a railcar. As the carriage continues to reverse, the dog will rise and the sensor will be reactivated, thereby completing a new engagement or transfer.

BRIEF DESCRIPTION OF THE DRAWINGS

In the drawings, wherein like numerals are utilized to designate like parts throughout the same.

DETAILED DESCRIPTION

Figure 1A:
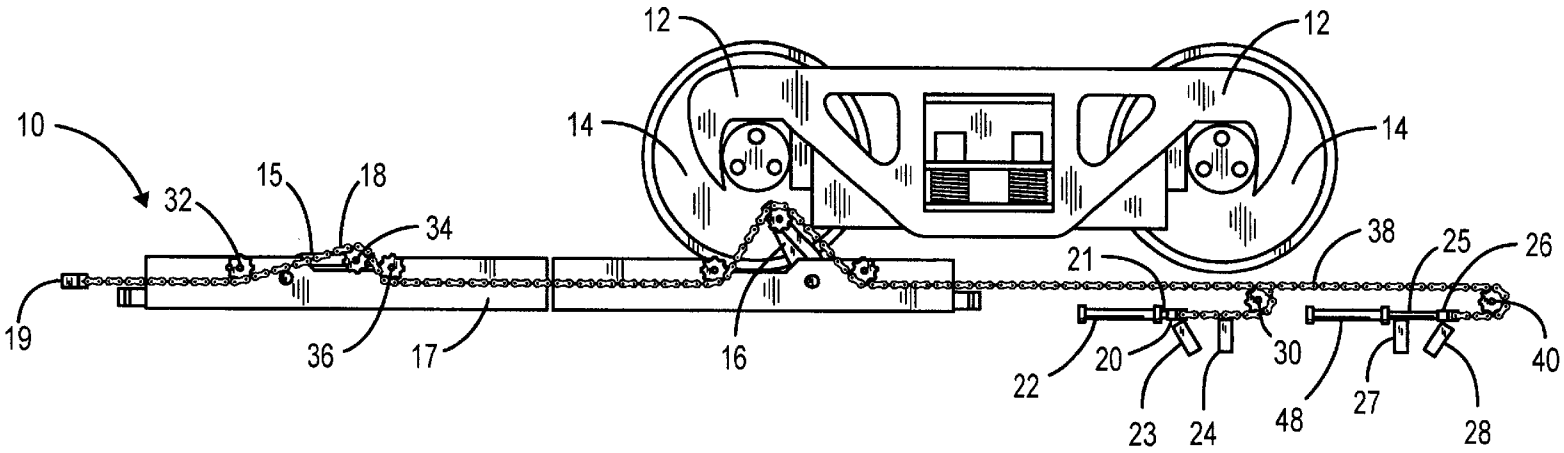
FIGS. 1A–1D show the dogs of an index carriage in various positions relative to a bogey frame in a reversing dual low-dog indexer arrangement.

The present invention increases the versatility of a dual dog reversing car spotting system by enabling operation with cars having protruding devices which interfere with traditional bogey frame-engaging dog operations. The system avoids the traditional contact between bogey frame and dogs to detect the presence of a car during hookup or transfer by providing an alternate sensing system in combination with an operating system for the dogs which allows them to be separably raised and lowered.

One embodiment of a low-dog indexer in accordance with the present invention is depicted in FIGS. 1A–1D and 2. One such indexer is shown generally at 10, together with a representative car carriage including a bogey frame 12 and wheels 14 which is illustrated as one of two carriages carrying a railway car and which is believed sufficient to illustrate the operation of the present invention. The indexer carriage includes a first or left dog 15 and a second or right dog 16 mounted on a carriage frame depicted at 17. Each of the dogs 15 and 16 is respectively operated by a separate chain connected between a fixed chain connector and a moving chain connector which, in turn, is connected to and operated by a hydraulic cylinder. Thus, dog 15 is connected by chain 18 between fixed chain connector 19 and moving connector 20 connected to the rod 21 of hydraulic cylinder 22. The position of the rod 21 is detected by a pair of associated spaced limit switches 23 and 24 as operated by the moving chain connector or knuckle 20. The chain 18 also traverses a drive sprocket 30 and idler sprockets 32, 34 and 36, idler sprocket 34 being attached near the top of the dog 15. In similar fashion, a chain 38 with drive sprocket 40 and idler sprockets 42, 44 and 46 are utilized to operate the dog 16. The chain 38 is also connected to fixed chain connector 19 and is operated by a cylinder 48 having a rod 25 connected to associated moving chain connection 26 which operates a pair of associated spaced limit switches 27 and 28.

Figure 1B:
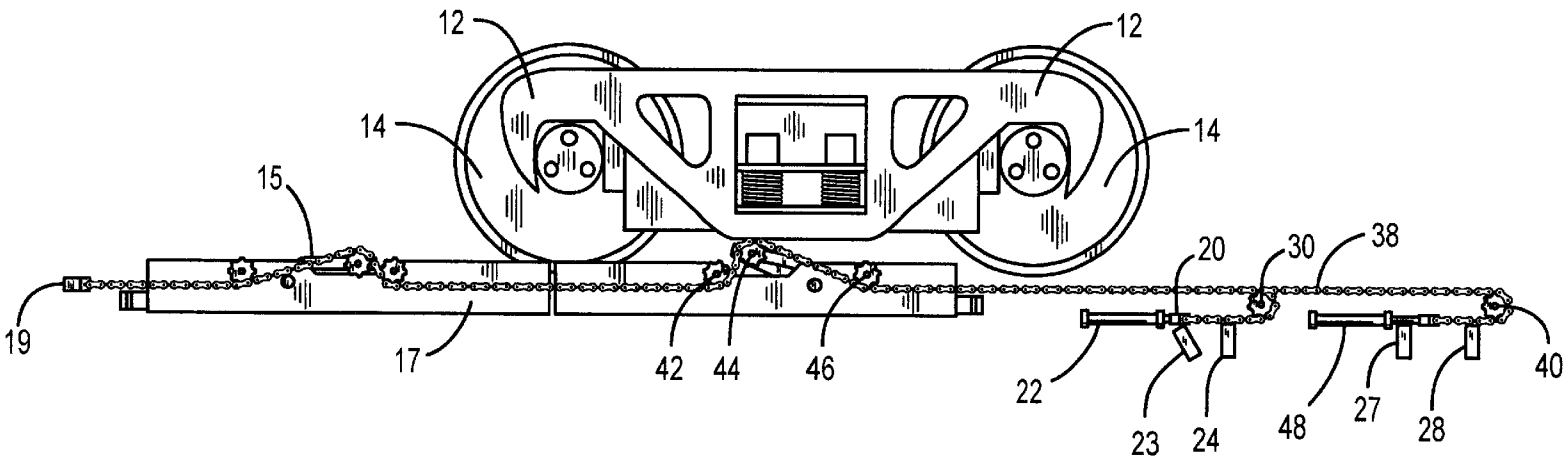
Figure 1C:
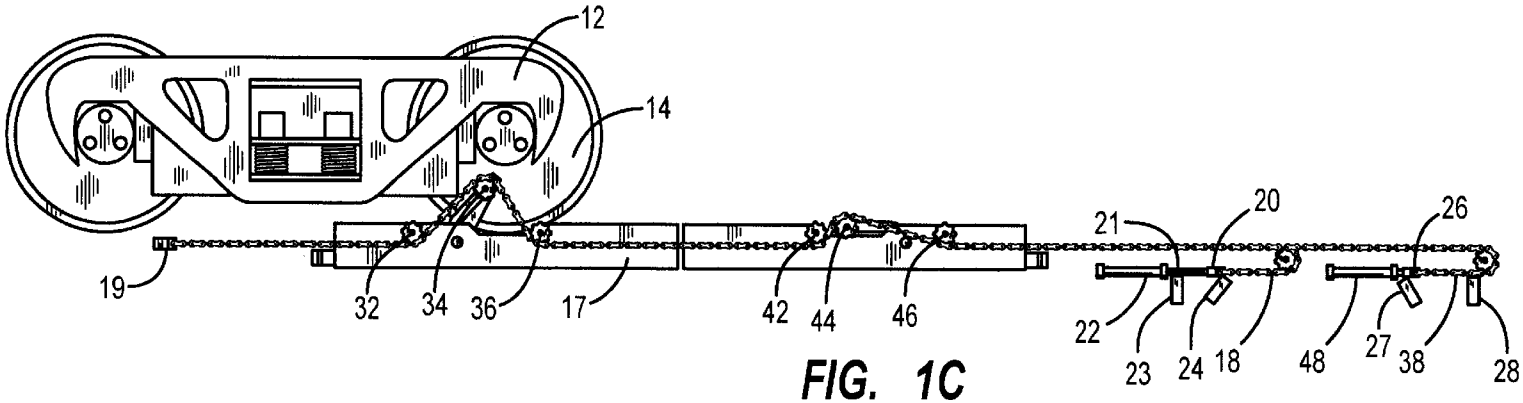
Figure 1D:
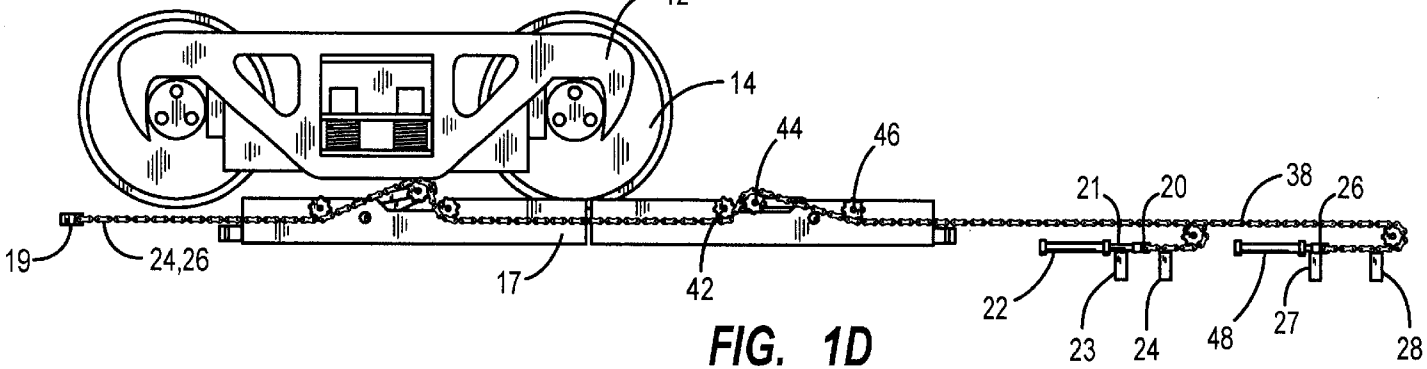

As can be seen from the figures, the dog 15 is in the lowered position and the dog 16 is in the raised position in FIG. 1A in which it is just about to encounter one side of the bogey frame 12. In FIG. 1B, the dog 15 is allowed to remain in the down position while the dog 16 is depressed and riding under the bogey frame 12. Note that this produces some slack in the chain 48 and the cylinder 48 retracts to take up this slack, the chain 38 remaining taut and switch 28 is released. In like manner, FIGS. 1C and 1D portray the system approaching a car carriage from the other direction with the dog 15 raised and the dog 16 in the lowered position. It should be noted that the system can approach a car using only a proximity sensor with both dogs lowered, if desired.

The system is preferably configured so that the connected cylinder rod is retracted when the associated dog is fully dropped and is extended when the dog is up. An intermediate position is assumed when the dog is partially lowered, as by an encountered bogey frame. It should be noted that the limit switches associated with each respective cylinder 22 and 48 are located and spaced so that near limit switches 23 and 27 are depressed when the rod is fully collapsed or retracted and that respective for limit switches 24, 28 are depressed by the connector 20, 26 when the rod is fully extended at intermediate positions neither switch is depressed. In this manner a depressed near limit switch indicates that the corresponding claim stacks have been taken up and the corresponding dog is down. Likewise, a depressed far limit switch indicates that the corresponding dog is in the up position. When the cylinder, and the corresponding dog are in an intermediate position, as when the dog rides beneath a bogey frame, neither switch is depressed.

Figure 2:
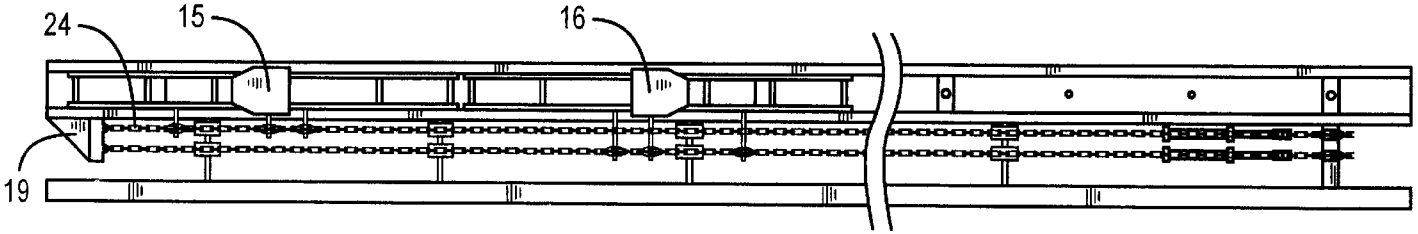
FIG. 2 depicts the arrangement of FIGS. 1A–1D as a right index carriage in broken plan view.

FIG. 2 shows a plan view of the car indexer of FIGS. 1A–1D showing the separate chain sprocket and cylinder systems of the consecutive dogs mounted closely parallel to each other along the indexer.

Figure 3A:
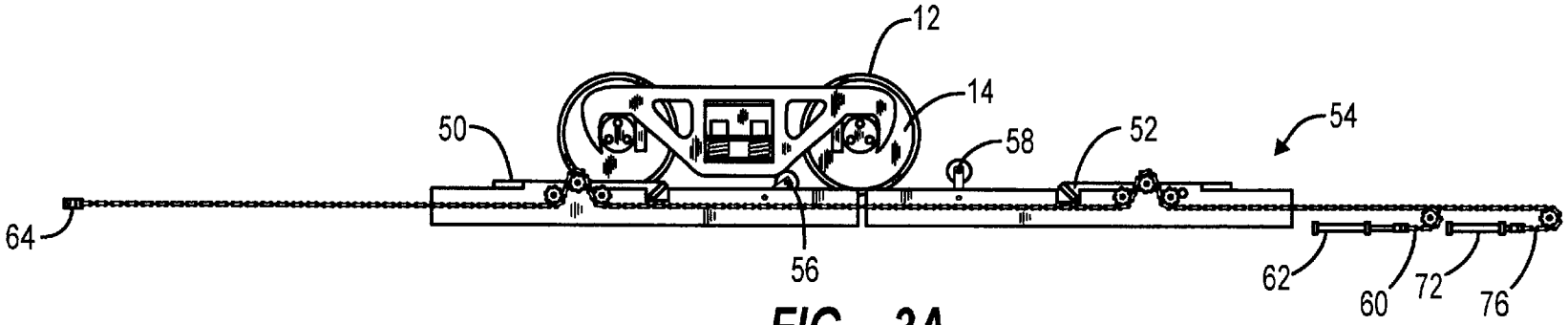
FIGS. 3A–3F depict the operation of a reversing dual high-dog indexing carriage in acquiring a bogey frame in a first direction.
Figure 3B:
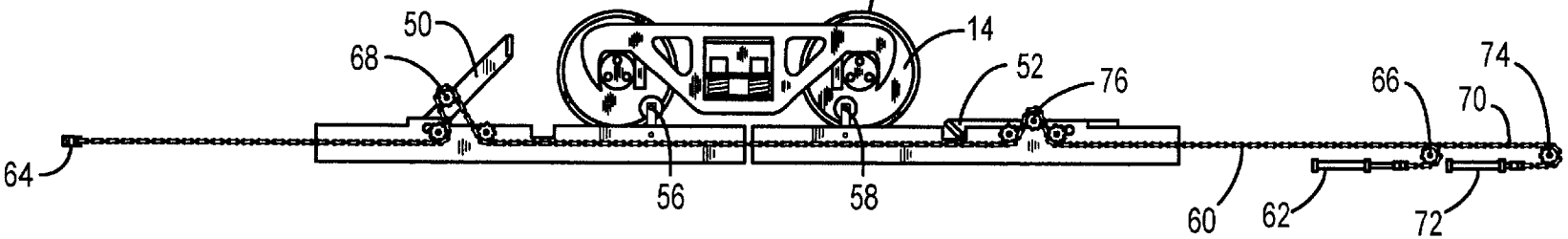
Figure 3C:
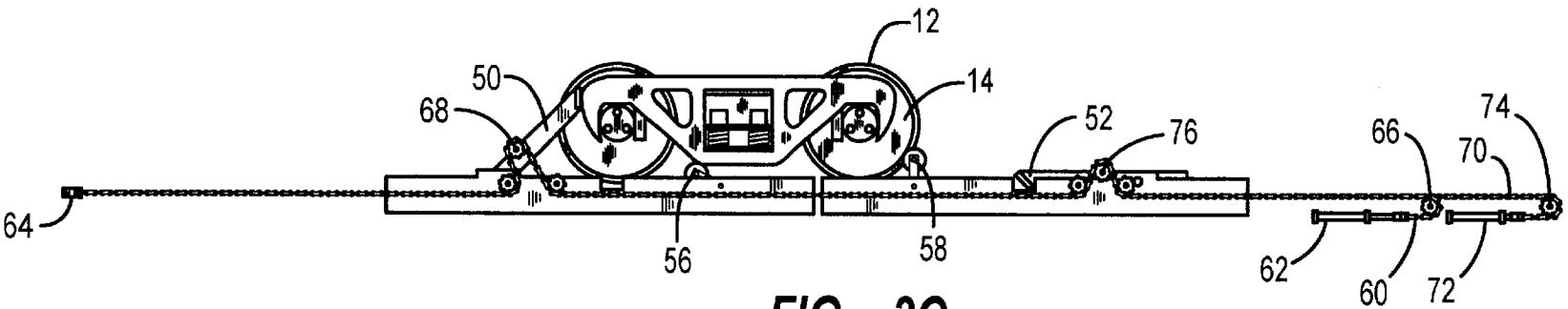

FIGS. 3–3C are similar to FIGS. 1A–1D illustrating a high dog indexer approaching and engaging a bogey frame from the two directions. The system includes high dogs 50 and 52 mounted on an indexer carriage 54, together with deflectable cams 56 and 58. Disposition of the dog 50 is controlled by chain 60 in conjunction with cylinder 62 and fixed chain connector 64. Other elements include a drive sprocket 66 and a series of idler sprockets including a sprocket 68 mounted high on the dog 50. Likewise, dog 52 is operated by a chain 70 with associated cylinder 72 and fixed chain connector 64. Drive sprocket 74 and idler sprockets including a dog mounted idler sprocket 76 are also provided to operate the dog 52. This system is shown in greater detail in the plan view of FIG. 4.

Figure 3D:
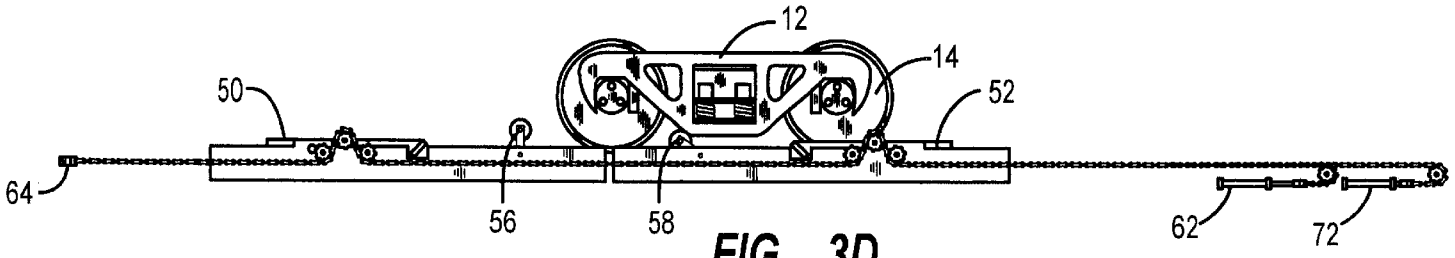
Figure 3E:
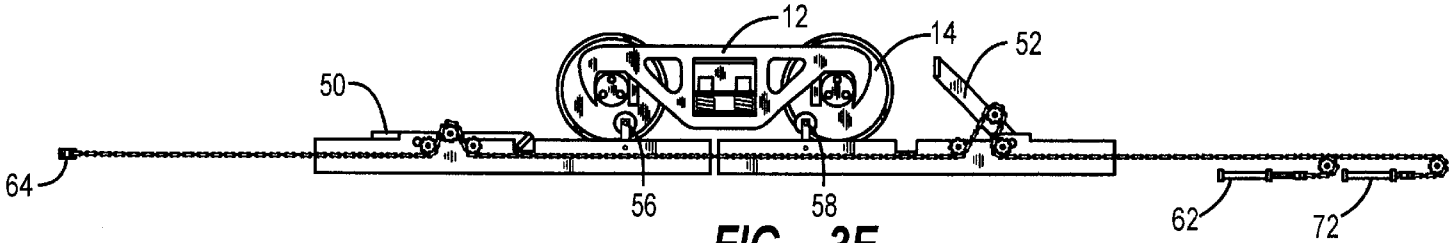
Figure 3F:
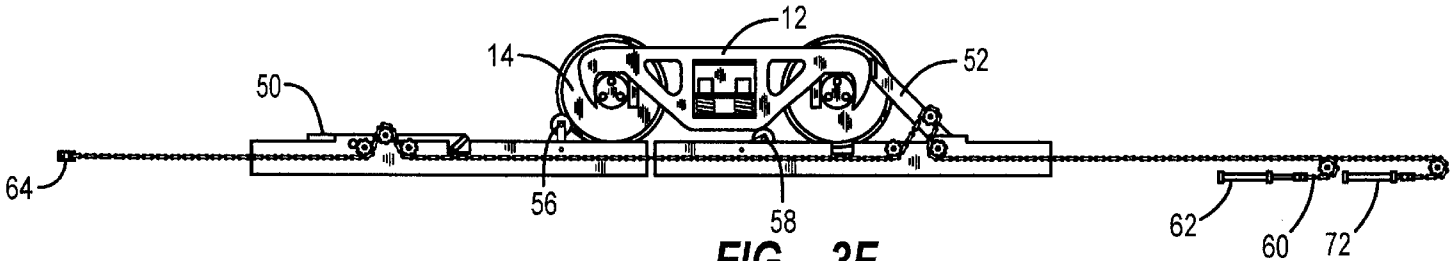
Figure 4:
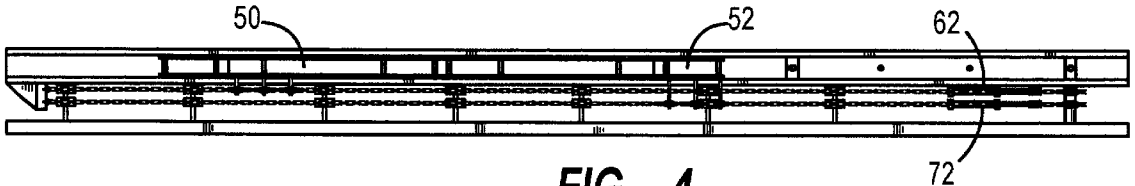
FIG. 4 depicts a broken plan view arrangement of the reversing dual high-dog indexing carriage of FIGS. 3A–3F.

In FIG. 3A, note that both dogs are down and that the indexer carriage in moving from right to left such that cam 56 is just encountering the bottom of bogey frame 12 and has been deflected. In FIG. 3B, the cam 56 has moved on and is now clear of the bogey frame 12 completing the detection of and fixing the position of the bogey frame such that the dog 50 can be raised and, as shown in FIG. 3C, the indexing carriage can be reversed so that the dog 50 will contact the bogey frame 12 and be in place for moving it to the right. In a like manner, FIGS. 3D–3F depict the operation of the system in the opposite direction with the dog 52 being raised at the appropriate time to encounter the bogey frame 12 for propelling the car in the opposite direction, i.e., right to left.

Figure 5:
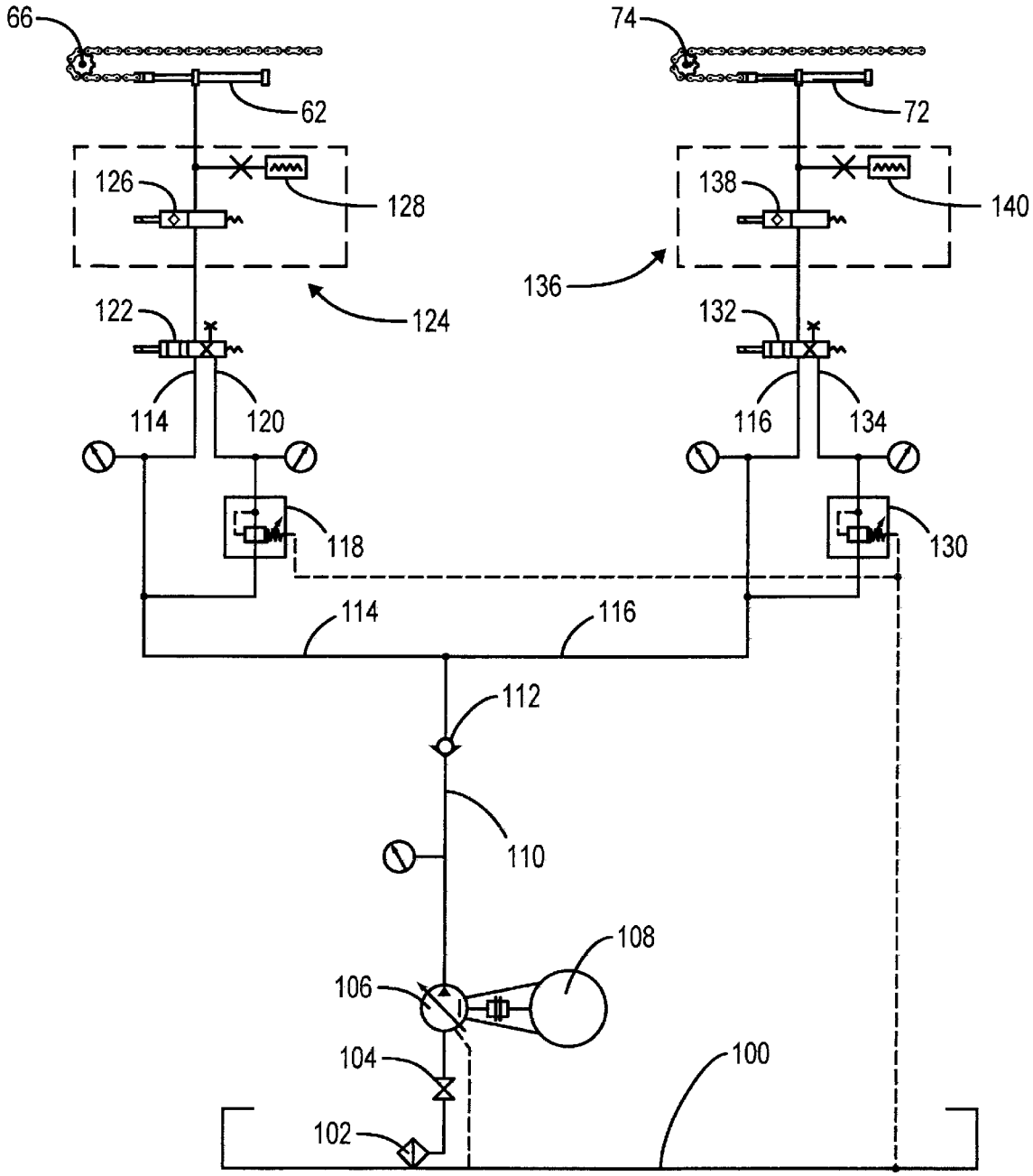
FIG. 5 is a schematic diagram of a hydraulic system for independently raising and lowering the dogs of a dual indexing carriage.

It will be appreciated from the above description that the ability to raise and lower the dogs separately is important for the successful operation of this system. The operation and control aspects of the indexing system of the invention are illustrated and described in conjunction with FIG. 5 which is a schematic diagram of the hydraulic system associated with both separate and unified operation of the dogs. As can be seen from FIG. 5, hydraulic fluid is supplied from a sump or reservoir 100 through a filter 102 and valve 104 to the intake of a pressure compensated pump 106 driven by a motor 108. Pressurized hydraulic fluid flows through a line 110 with check valve 112 and splits into lines 114 and 116, each of which is used to control the operation of one of the two dogs. The dog control system may be explained utilizing left and right dogs 50 and 52 as in FIGS. 3A–3F as examples.

As shown in the diagram, identical control systems are provided for each dog 50 and 52 and corresponding control cylinders 62 and 72. In the case of cylinder 62, the system includes a pressure reducing valve 118 which reduces the pressure in line 120 to below that necessary to cause the spring biased dog to pivot down. A two-position valve is provided to select which oil pressure will be directed to the rod end of cylinder 62, i.e., the high pressure in line 114 or the reduced pressure of line 120. In the case of the high dog system with cam bogey frame detection, additional controls found in the box formed by dashed lines at 124 are provided. These include a further two-position, two-way valve 126 and a pressure transducer 128. The two-position valve 126 is used to lock the pressure between the valve and the cylinder so that when the cam actuator goes under a bogey frame, the pressure in the line between the valve and the rod end of cylinder 62 will increase enough to be detected. This is operated in conjunction with the valve 122 also to assure that sufficient pressure remains in the line to overcome the spring bias of the dog 50. In a like manner, the dog 52 is controlled utilizing cylinder 72 and chain drive sprocket 74. That system includes pressure reducing valve 130, two-positioned solenoid operated valve 132, which selects oil from lines 116 and 134. Likewise, a box 136 is provided with further two-way solenoid operated valve 138 and pressure transducer 140.

In the normal operating condition, after the power unit is started, the pressure at the cylinders 62 and 72 will be limited by the respective pressure transducers 118 and 132 to an amount less than that necessary to overcome the spring bias holding the respective dog up, but at a sufficient pressure so that the chain will remain taut. When the indexer is moving through the track looking for a car or performing a transfer, the dogs will be pulled down as shown in FIGS. 3A and 3D. In this mode, the cam actuators become active and when a cam goes under a bogey frame, as depicted in FIGS. 3A and 3D, the chain will pulled and this will cause a pressure spike in the system which will subsequently disappear when the cam again comes out from under the bogey frame of the car. This sequence of events signals the indexer to stop moving and for the appropriate valve 122, 132 to switch to the low pressure position so that the appropriate dog that relates to the direction the cars are being moved is allowed to pop up or raise and the indexer thereafter reverse to bring the dog into contact with the bogey frame for subsequently moving the car in the direction indicated.

A system using limit switch or another type detector not requiring the cam system as in the low dog system eliminates the need for the locking valve and pressure transducer. It will be appreciated that any suitable type of proximity sensor or similar device suitable for operation in the car spotting system might alternatively be employed to sense the presence and location of the cars.

The valves 122 and 132 are typically two-position, four-way, spring offset, solenoid operated directional control valves which simply determine whether the dog is pulled down or allowed to rise with the chain taut. The pressure reducing valves 118 and 130 are typically set to a reduced pressure of approximately 100 psi or the like so that the chain will remain taut and any slack will be taken out, but that the dog will remain in the upright position based on the biasing spring and the dog construction.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself. For example, the wear shoes of the invention may be employed in other comparable applications where comparable devices are indicated.

What is claimed is:

1. A dog carriage system for a railway car indexing system for positioning a railway car or a trip of coupled railway cars, the cars having railway wheels mounted in and carrying bogey wheel truck frames, the dog carriage system operating by pushing against successive bogey wheel truck frames using frame-engaging dogs, said dog carriage system comprising:

(a) a dog carriage frame moveable along a railroad track;

(b) a pair of spaced opposed dogs including a first dog and a second dog pivotally attached to said dog carriage frame for pivoting in opposed directions between a fully lowered, dropped position and a raised position, wherein each dog in the raised position is positioned to engage a proximate bogey wheel truck frame by movement of said dog carriage frame;

(c) a bogey wheel truck frame sensing device for sensing a proximate bogey wheel truck frame carried on said dog carriage frame; and (d) a dog operating system including separate chain and sprocket arrangements and chain tension controlling devices for controlling the position of each of said first dog and said second dog individually between said fully lowered, dropped position and said raised position.

2. The dog carriage system of claim 1 wherein said bogey wheel truck frame sensing device includes a pair of spaced limit switches.

3. A dog carriage system for a railway car indexing system for positioning a railway car or a trip of coupled railway cars, the cars having railway wheels mounted in and carrying bogey wheel truck frames, the dog carriage system operating by pushing against successive bogey wheel truck frames using frame-engaging dogs, said dog carriage system comprising:

(a) a dog carriage frame moveable along a railroad track;

(b) a pair of spaced opposed dogs including a first dog and a second dog pivotally attached to said dog carriage frame for pivoting in opposed directions between a fully lowered, dropped position and a raised position, wherein each dog in the raised position is disposed to engage a proximate bogey wheel truck frame by movement of said dog carriage frame and wherein each of said first dog and said second dog includes an associated bias spring which normally maintains each dog in said raised position;

(c) a bogey wheel truck frame sensing device for sensing a proximate bogey wheel truck frame carried on said dog carriage frame; and (d) a dog operating system for controlling the position of each of said first dog and said second dog individually between said fully lowered, dropped position and said raised position, said operating system further comprising for each dog:

(i) a sprocket carried by each dog;

(ii) a length of chain carried by said sprocket in a manner such that when tension is applied to said chain, it creates a force that opposes said bias spring;

(iii) a chain tensioner for adjusting the tension in said chain between a first tension which is sufficient to cause said chain to be taut but is insufficient to lower the dog and a second tension which overcomes said spring and fully lowers said dog; and (iv) tension control system, including control mechanism for controlling the tension in said chain between said first and said second tensions, associated with each of said dogs.

4. The dog carriage of claim 3 wherein said chain tensioner is a fixed hydraulic cylinder and said chain is connected between said fixed hydraulic cylinder and a fixed connector.

5. The dog carriage system of claim 4 wherein said tension control system further comprises a high pressure source of hydraulic fluid, a reduced pressure source of hydraulic fluid and a two-position valve connected between said sources of said high pressure and low pressure sources of hydraulic fluid and each said hydraulic cylinders.

6. The dog carriage system of claim 5 wherein said bogey wheel truck frame sensing device includes a pair of spaced deflectable cam devices between said first and second dogs; two-position locking pressure control valve connected between first two-position valve and said cylinder; and pressure transducer in the line between said second two-position pressure locking valve and said cylinder; wherein the deflection of one of said deflectable cams produces a pressure change in the hydraulic system supplying the corresponding dog and wherein the change of signal indicating a pressure change transmitted by said pressure transducer indicates that the cam has gone under a proximate bogey and wheel truck frame.

7. The dog carriage system of claim 6 wherein said dogs are high dogs.

* * * * *